US005705024A

United States Patent [19]

Bainbridge et al.

[11] Patent Number: 5,705,024

[45] Date of Patent: Jan. 6, 1998

[54] SYSTEM FOR APPLICATION OF LABELS

[75] Inventors: Eric Bainbridge; John Hitchings, both of Plymouth, England

[73] Assignee: Becton, Dickinson and Company, Franklin Lakes, N.J.

[21] Appl. No.: 534,917

[22] Filed: Sep. 28, 1995

[51] Int. Cl.[6] ..... B65C 3/02; B65C 3/12

[52] U.S. Cl. ..... 156/475; 156/485; 156/542; 156/566; 156/568; 156/DIG. 6; 156/DIG. 11; 156/DIG. 13; 156/DIG. 17; 156/DIG. 33; 156/DIG. 42

[58] Field of Search ..... 156/485, 475, 156/542, 566, 568, DIG. 6, DIG. 11, DIG. 12, DIG. 13, DIG. 17, DIG. 33, DIG. 42

[56] References Cited

U.S. PATENT DOCUMENTS

| | | | |
|---|---|---|---|
| 3,174,888 | 3/1965 | Morgan . | |
| 4,115,179 | 9/1978 | Carter | 156/444 |
| 4,347,094 | 8/1982 | Watanabe | 156/387 |
| 4,522,672 | 6/1985 | Brister | 156/DIG. 33 |
| 4,624,734 | 11/1986 | Voltmer | 156/541 |
| 4,758,300 | 7/1988 | King | 156/357 |
| 4,793,891 | 12/1988 | Freeman | 156/476 |

*Primary Examiner*—Jenna Davis
*Attorney, Agent, or Firm*—Arthur D. Dawson

[57] ABSTRACT

A system for applying labels to objects includes an object supply for supplying objects substantially equally spaced and aligned in single file for labeling. The system also includes a label applicator for applying a label to an object from the object supply and a label supply for supplying the labels to the label applicator. Each of the labels are joined at an end to at least one other of the labels. The system also includes a labeling finisher to detach the end of each label from the at least one other label and to smooth the end of each label onto their respective object.

19 Claims, 4 Drawing Sheets

SYSTEM FOR APPLICATION OF LABELS

FIELD OF INVENTION

The present invention generally relates to the labeling of objects and more particularly to a system for high speed application of labels to objects.

BACKGROUND

Many manufactured articles have one or more labels attached to the article. Labels are applied to manufactured articles for many reasons. They provide identification, instructions for use and, increasingly, provide evidence of tampering with or prior use of the article.

Tamper evidence or evidence of prior usage of an article is particularly important in the medical device industry. Many medical devices are intended only to be used once, then properly disposed of. These devices are also often supplied as "sterile until opened." Sterile single use medical devices often have a label applied over a joint between a removable cover and a functional part of the device. The cover serves as a barrier to the passage of microorganisms and provides physical protection to the functional part of the device. The label over the joint with the cover provides the tamper evidence on these sterile single use medical devices. When used in this fashion, the label is generally designed to adhere strongly to the elements forming the joint and be irreversibly visually altered when the cover is moved with respect to the functional part of the device. The alteration of the label provides visual evidence that the cover has been moved and that the sterility barrier of the device has been breached.

Single use medical devices are often produced and used in large volumes and, given the recent attention to the high costs of medical treatments, the costs of medical devices used in the treatments are often scrutinized. In the manufacture of medical devices, manufacturing efficiency, i.e. , cost control, is an important factor in the design of both the device itself and in the systems used to produce the device. Even when a label is only used to provide information on a medical device, the label is a critical element of the device. Labeling of medical devices is carefully regulated under good manufacturing practices (GMP) as part of Food and Drug Administration (FDA) regulations. The labeling of the device is carefully defined during the device approval process and, if only a few labels in a manufacturing lot are not applied as specified, the entire lot may be unusable.

When a label additionally serves as tamper evidence for sterile single use devices, several other requirements are added. The tamper-evident labels not only need to be securely applied to the device, they must be visually altered when the device is opened, and they should not substantially impede the opening of the device for its intended use.

Given the stringent requirements on labeling for medical devices, the cost of labeling single use medical devices is a significant factor in the cost of many sterile single use medical devices. An example of a medical device produced in high volume where the label is used for tamper evidence is a disposable needle assembly used with evacuated blood collection tubes. The needle assembly has a hub for holding a needle that has one end to penetrate the patient's vein and another end to pierce a rubber stopper on the evacuated blood collection tube. Each end of the needle is covered by a needle shield mounted onto the hub to protect their respective needle end. One needle shield abuts a side of a circumferential rib on the hub and the other shield fits over a portion of the first shield forming a joint that has a label applied over it. This label serves to secure the shields to each other and, when either shield is moved with respect to the other, the label is irreversibly torn, providing evidence that the sterility of the assembly may have been compromised.

The needle assemblies are produced on a carrier system where the hub is mounted onto a station on the carrier, the needle is fitted into the hub with the patient penetrating end upward, the needle is bonded into the hub, and then the first needle shield is fitted onto the hub to shield the patient end of the needle. These partially completed assemblies are then transferred to a rack where the stopper penetrating end of the needle is upward. A resilient valve is then installed over the stopper penetrating end of the needle and the second needle shield is positioned onto the hub. In a secondary operation, the shielded assemblies are removed from the rack, fitted into a labeling apparatus and a label applied over the joint between the shields. The assemblies are then packaged and exposed to conditions that render any microorganisms inside the assembly nonviable. These assemblies are then considered sterile until one shield is removed. In clinical use, a phlebotomist removes the shield from the stopper penetrating end of the needle assembly, mounts the assembly on a needle holder and removes the shield from the patient penetrating end of the needle to withdraw blood from a patient. Since the label provides evidence of movement of the shields with respect to each other, if the label is not strong enough, either shield may be moved during shipment or handling prior to actual use, tearing the label and causing the phlebotomist to discard the assembly as possibly contaminated. If the label is too strong, the phlebotomist may have difficulty in removing the shields, causing an inefficiency in the clinical usage of the needle assembly.

In many manufacturing operations, the cost of handling the article to apply a label, either by hand labor or by a separate machine operation, is significant. As a result, in most large volume high speed manufacturing operations, efforts are made to eliminate handling steps to simplify the operation, increase efficiency and potentially to reduce costs. The current system of labeling the needle assemblies described above requires a separate handling step and separate equipment to remove the finished assemblies from the racks where they were assembled. The label is then applied in a secondary operation. If a system was available that reliably applied the labels to the assemblies while they were still in the assembly racks, the efficiency of the manufacturing process would be improved. A system is disclosed below with this capability.

SUMMARY

A system of the present invention for applying labels to objects includes an object supply for supplying objects substantially equally spaced and aligned in single file for labeling. The system also includes a label applicator for applying a label to an object from the object supply. There is a label supply for supplying labels to the label applicator, with each of the labels being joined at an end to at least one other of the labels. The system of the invention further includes a labeling finisher to detach the end of each label from the other label.

The labeling system of the invention is particularly well suited for application of tamper evidence labels over a joint between the shields and the hub of a needle assembly used with evacuated blood collection tubes. The system of the invention utilizes a rack system currently used for assembling the needle assemblies to deliver the assemblies to the label applicator where labels are applied to the assemblies while they are mounted in the racks. The labeling system of the invention simplifies the current manufacturing process by eliminating a separate handling step. The labels applied by the system reliably meet the stringent GMP requirements for the devices and, additionally, allow a phlebotomist to easily remove the covers from the hub in clinical usage.

DETAILED DESCRIPTION

Figure 1:
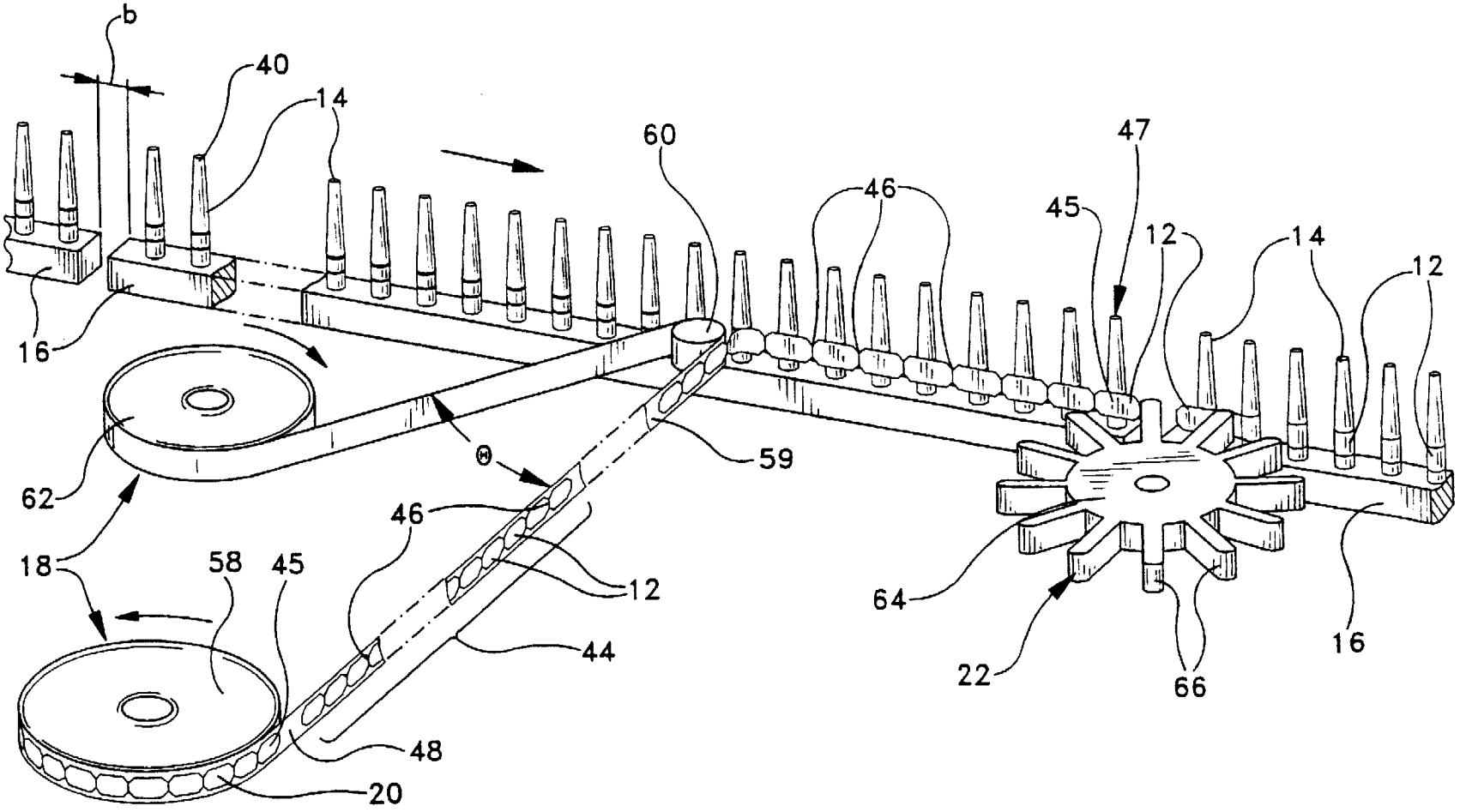
FIG. 1 is a schematic perspective view of the preferred system of the present invention.

While this invention is satisfied by embodiments in many different forms, there is shown in the drawings and is herein described in detail a preferred embodiment of the invention with the understanding that the present disclosure is to be considered exemplary of the principles of the invention and is not intended to limit the invention to the embodiment illustrated. The scope of the invention is measured by the appended claims and their equivalents.

Referring to FIGS. 1–5, a preferred system 10 of the present invention is useful for applying labels 12 to needle assemblies 14. System 10 includes a supply 13 of needle assemblies 14 to have labels 12 applied at a label applicator 18. Preferably assemblies 14 are mounted on a plurality of racks 16, each having twenty-five assemblies, so that assemblies 14 are substantially equally spaced and aligned in single file. System 10 includes a label supply 20 to provide labels 12. After the labels are applied to needle assemblies 14 at the label applicator, the labeled assemblies still mounted in racks 16, pass through a label finisher 22 to complete the labeling.

Figure 2:
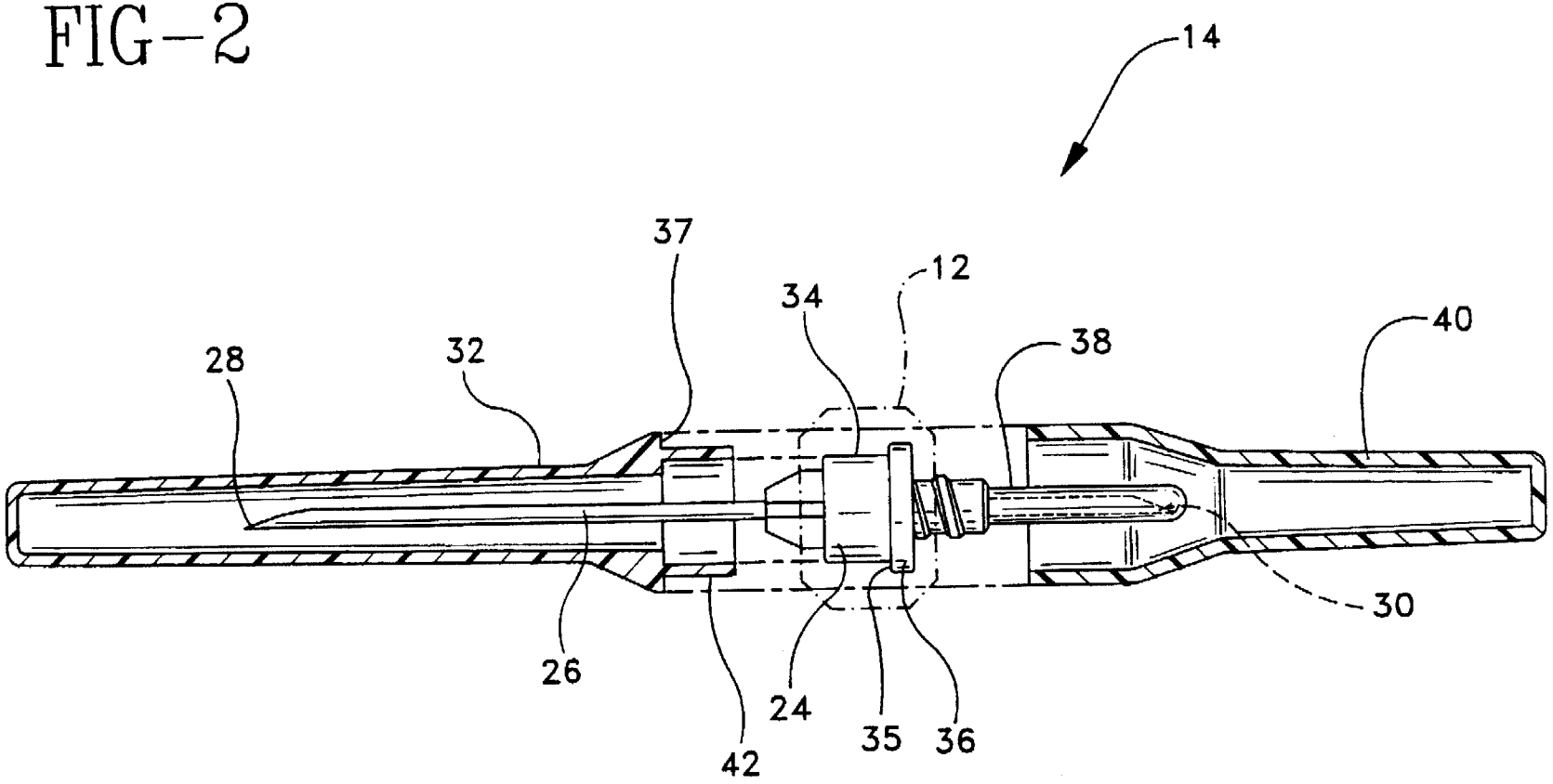
FIG. 2 is a partially exploded schematic side elevation of a needle assembly used with evacuated blood collection tubes as labeled in the system of FIG. 1.

In this preferred example, labeling system 10 is used to apply labels 12 to a plurality of needle assemblies 14 as illustrated in FIG. 2. The system of the present invention is suitable for the application of labels to informational labels and tamper evident labels to substantially any object produced in large quantities that can be supplied to the label application station substantially equally spaced in single file. The system of the invention is particularly well suited for labeling sets of objects that are already produced in assembly racks with a predetermined number of objects in each rack. The system of the invention is capable of application of the labels to the objects while they are still in their racks. This capability of the system of the invention to apply labels to the objects while they are still in the assembly racks substantially maintains the object orientation and count already present in an existing system and generally improves the efficiency of the overall manufacturing process for the objects. It is intended that application of labels to objects other than needle assemblies and other than medical devices be included in the scope of the present invention.

A brief description of the current manufacturing process for the needle assemblies is provided as background to assist understanding of the preferred labeling system. Referring to FIG. 2, needle assembly 14 includes a needle hub 24 for mounting a needle 26 that has a patient penetrating end 28 and a stopper penetrating end 30. In the manufacture of needle assemblies 14, hub 24 initially is mounted into a carrier and then needle 26 is fitted into the hub so that patient penetrating end 28 of the needle is upward. Needle 26 is then bonded to the hub and a patient end needle shield 32 is fitted. Shield 32 covers patient penetrating end 28 of the needle and mounts onto a first part 34 of hub 24 to abut one side 35 of a circumferential ring 36 on hub 24. The partially completed assembly is then removed from the carrier and placed in rack 16 (as seen with completed assemblies 14 in FIG. 1) so that stopper penetrating end 30 of the needle is upward. A resilient valve 38 is then placed over stopper penetrating end 30 and a stopper penetrating end shield 40 is fitted. Shield 40 covers stopper penetrating end 30 and mounts onto a portion 42 of shield 32 to abut a shoulder 37 on shield 32. A label is then applied to the assembly covering at least a portion of the juncture of shields 32 and 40. In the existing labeling system, the completed assembly is removed from the rack, individually placed onto a separate labeling apparatus and the label is applied in a secondary operation.

Figure 4:
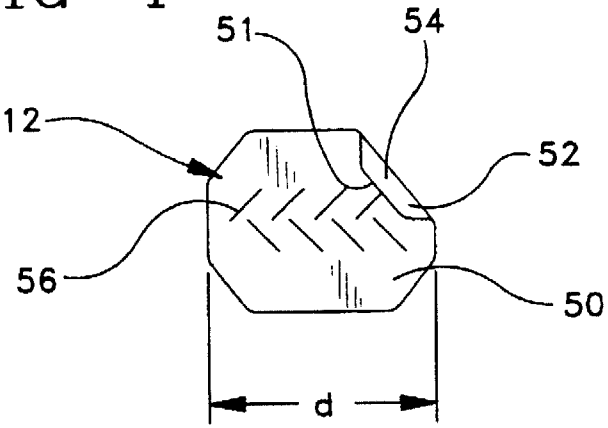
FIG. 4 is a schematic layout of an individual label as applied to the needle assembly of FIG. 2 by the system of FIG. 1.
Figure 5:
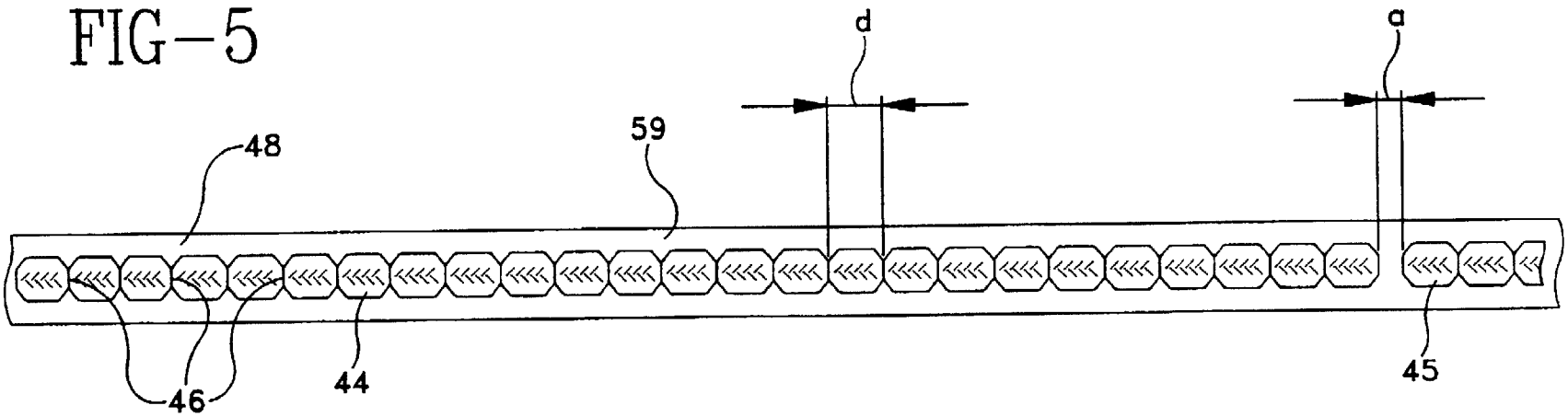
FIG. 5 is a schematic layout of a set of the labels as shown in FIG. 4 mounted on a continuous release strip for application by the system of FIG. 1.

When using preferred system 10 of the present invention for labeling of assembly 14, label supply 20 includes a multiplicity of labels 12 as shown in FIGS. 4 and 5. Each label is joined at an end 41 to at least one other label as shown in FIG. 5. In the preferred application used here as an example of system 10 of the invention, labels 12 are supplied in a plurality of sets 44 each with twenty-five labels 12 having a perforation 46 at the end 41 where it joins the other label to form the set corresponding to the twenty-five needle assemblies 14 in each of racks 16. Sets 44 of the labels are releasably mounted on a continuous release strip 48. For other applications, the labels either may be continuous or in sets having larger or smaller numbers of labels to correspond to the object supply.

As shown in FIG. 4, label 12 has an exposed side 50 and an adhesive side 52 (schematically illustrated by a turned down corner 51). Adhesive side 52 has a layer of pressure sensitive adhesive 54 applied to it. Adhesive 54 releasably adheres labels 12 onto release strip 48 and fixedly adheres labels 12 to assemblies 14. Suitable adhesives include, but are not limited to hot melts, aqueous based and solvent based adhesives. Label 12 may be formed from paper, nonwovens, polymeric films and the like. Preferably, label 12 is formed from paper and includes a tamper evident portion 55 having reduced strength due to a multiplicity of slits 56 through the label in the reduced strength portion. Because adhesive 54 fixedly adheres label 12 to the assembly, preferred label 12 is visibly irreversibly torn, preferably at slits 56, if either shield 32 or shield 40 is moved with respect to each other, providing the tamper evidence property. Other forms of tamper evidence provided by openings in the label, notching and the like, are suitable to provide reduced strength in at least a portion of the label, in addition to the preferred slits, and are considered within the scope of the invention.

As seen in FIG. 1, label applicator 18 preferably includes a first reel 58 containing label supply 20 on one side 59 of release strip 48. Release strip 48 is preferably unrolled from reel 58 around roller 60, with side 59 facing the objects, in this example, assemblies 14, and taken up around second reel 62. Roller 60 is positioned so that an acute angle $\theta$ is formed by the release strip from reel 58 to reel 62. As the release strip with the labels travels around the acute angle formed at roller 60, labels 12 are partially detached from side 59 of the release paper, presented to and transferred to each assembly 14 as the assemblies in the racks are moved past the roller.

Figure 3:
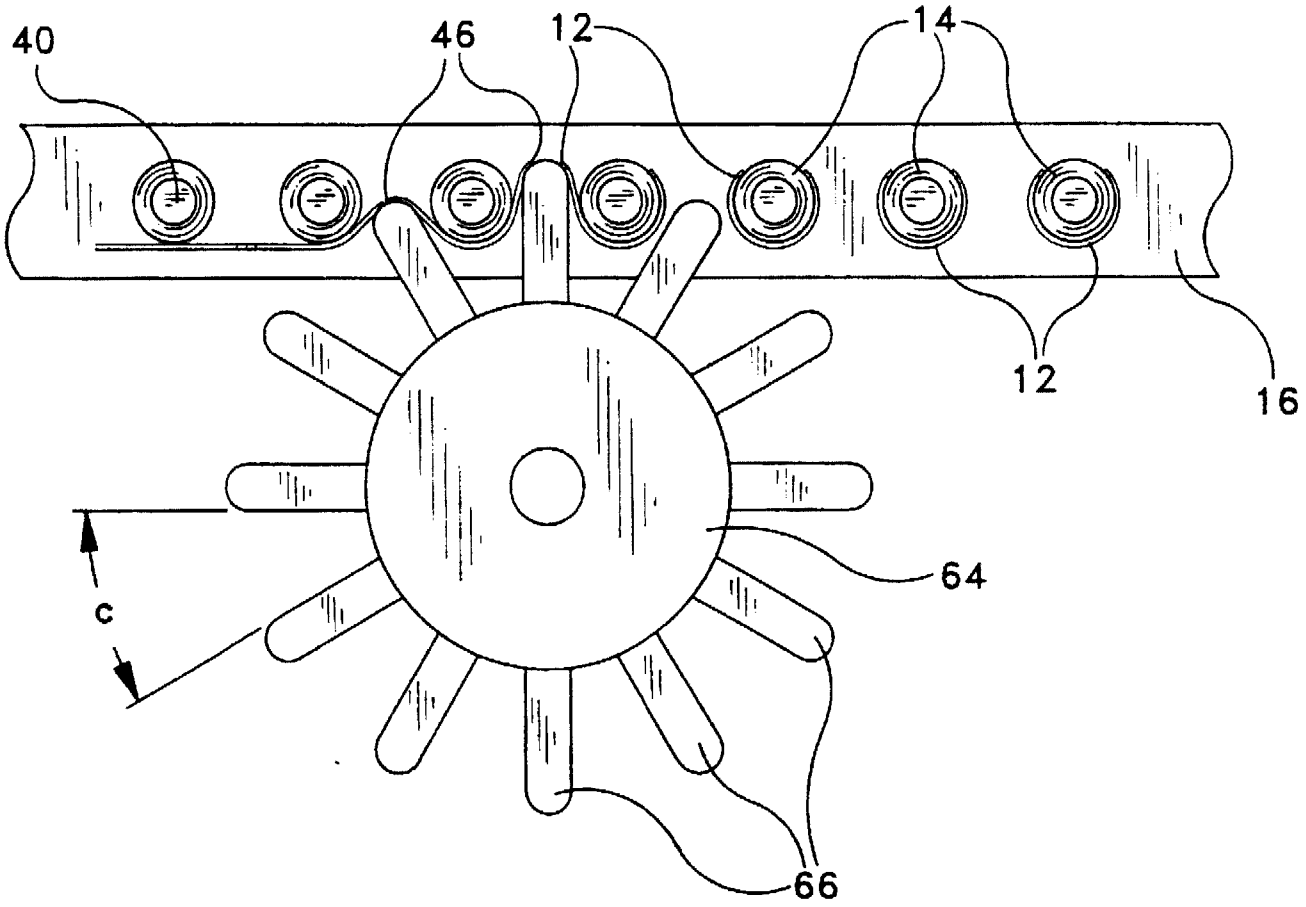
FIG. 3 is an enlarged schematic top plan view showing the label finisher portion of the system of FIG. 1.

Referring to FIGS. 1 and 3, roller 60 is preferably positioned so that as labels 12 are partially detached from release strip 48 as the release strip moves around acute angle θ assemblies 14 are contacted by the partially detached label. As both the release strip and assemblies are advanced, labels 12 are stripped from release strip 48 a transported to finisher 22 to be fully adhered to assemblies 14 and detached from each other.

In the preferred embodiment, the labels, as shown in FIG. 5, are supplied in sets 44 spaced apart on continuous release strip 48 a distance "a" allowing for a spacing "b" between the racks as seen in FIG. 1. Additionally, the spacing distance "a" between sets 44 allows the label supply to be started and stopped, allowing the label supply to be substantially conformed to the delivery of the racks containing the needle assemblies so that a "start" label 45 of sets 44 of the labels is presented to and transferred to an initially positioned needle assembly 47 of the racks of assemblies at label applicator 18. Within sets 44, the labels are sized and spaced so that perforation 46 is intermediate the uniformly spaced assemblies on the racks when the labels are applied to the assemblies. After the labels are applied to the assemblies, the assemblies, still in racks 16, are moved to the label finisher 22.

As shown in FIGS. 1 and 3, preferred label finisher 22 includes a wheel 64 with a plurality of teeth 66 that have a pitch "c" corresponding to distance "d," the distance between perforations 46 of the labels in sets 44. Referring to FIG. 3, wheel 64 is positioned so that teeth 66 engage perforations 46 as the racks with the assemblies are moved through the system and detach the labels from one another at the perforations. Additionally, teeth 66 serve to smooth the ends of the labels onto the assemblies, substantially ensuring that the labels are securely adhered to the assemblies.

Assemblies labeled by the system of the present invention were compared to assemblies labeled using the current system that requires the secondary operation. The comparison measured the torque required to twist the needle shields and break the label. One hundred randomly selected assemblies of each type were collected from each of two trial runs and the label breakage torque was determined with a standard laboratory strain gauge. The results of the comparison showed that labels applied by the preferred system of the present invention required only about sixty percent of the force required to break labels applied by the existing system. The reduced label breakage torque is a benefit to the end-user phlebotomist. In machine trials for efficiency and speed of labeling, the preferred system of the present invention was capable of reliably applying labels to more than one thousand assemblies per minute compared to the capacity of four to five hundred per minute of the existing system.

The system of the present invention is mechanically less complex than the existing system, eliminating an entire handling step and the mechanically complex secondary operation. Using the system of the present invention, the orientation and the numerical count of the labeled assemblies is maintained through the labeling because the labeled assemblies are still in the racks in which they were assembled. In the preferred system, the finished labeled assemblies are transferred directly into their final package from the assembly racks. Then, the packages are sealed and exposed to conditions rendering nonviable any microorganisms contained therein. Suitable conditions for rendering microorganisms nonviable include, but are not limited to, exposure to ethylene oxide and ionizing radiation. After the exposure, the labeled assemblies are considered "sterile" until the shields are removed. The label applied by the system of the present invention provides evidence of any movement of the shields with respect to the hub.

The preferred system of the present invention substantially improves the efficiency of the labeling of needle assemblies by eliminating the secondary operation and additional handling of the assemblies required by the current labeling operation. The system is compact and easily fits into less space than is occupied by the equipment used in the current secondary operation. The system of the invention is capable of reliable sustained high speed operation and provides a labeled product with superior end-user use properties to those provided by the current labeling operation.

What is claimed is:

1. A system for applying labels to objects comprising:

an object to be labeled;

a label having a first end and a second end to be applied to said object:

an object supply for supplying a number of said objects substantially equally spaced and aligned in single file for labeling;

a label applicator for applying one of said labels to each of said objects from said object supply;

a label supply for supplying said labels to said label applicator, each of said labels being joined on at least one of said ends to at least one end of another of said labels thereby to join said objects together when said labels are applied to said objects; and a labeling finisher to detach said ends of said each label from said at least one other label and to separate said objects.

2. The system of claim 1 wherein the objects are supplied in sets having a predetermined number of objects.

3. The system of claim 2 wherein said label supply comprises a continuous strip of release paper having a multiplicity of labels releasably adherent to one side thereof.

4. The system of claim 3 wherein said label supply further comprises said labels being supplied in sets of labels, each of said set of labels having a number of labels corresponding to said number of objects in said set of objects, said sets of labels being spaced a predetermined distance apart on said continuous release paper strip.

5. The system of claim 4 wherein said labels are formed from paper and have an exposed side and an adhesive side with a layer of pressure sensitive adhesive thereon for releasably adhering said labels to said release paper and for fixedly adhering said labels to said objects.

6. The system of claim 5 wherein said label applicator further comprises a first reel having said supply of labels thereon, said strip being unrollable from said first reel around a roller to form an acute angle between said first reel and a second reel, said second reel serving to take up said continuous strip of release paper after said labels are transferred to the objects, said label roller being disposed to present and to transfer said labels from said release paper strip to the objects.

7. The system of claim 1 wherein the joining of each label to at least one other label comprises perforations spaced at predetermined intervals so that one of each labels is applied to one of each of the objects and said perforations are intermediate each of the objects.

8. The system of claim 7 wherein said each label is detachable from said at least one other label at said perforation by said label finisher.

9. The system of claim 8 wherein said label finisher comprises a wheel having a plurality of outward teeth having a pitch substantially equal to the spacing between said perforations, said label finisher being sized and positioned so that said teeth engage said perforations as the objects are moved through said label finisher, and detach each of said labels from said at least one other label at said perforations.

10. A system for applying tamper-indicating labels to shielded needle assemblies having a hub and shields at a juncture between the shields and the needle hub comprising:

a supply of shielded needle assemblies each including two shields releasably mounted on opposing ends of a needle hub forming a juncture on the hub, the assemblies being arrayed in racks having a predetermined number of the assemblies substantially equally spaced and aligned in single file for labeling;

a label applicator for receiving the racks of assemblies and applying a label to each of the assemblies at the juncture between the shields and the needle hub;

a label supply for supplying labels to said label applicator, said labels being supplied in sets having a number of labels corresponding to the predetermined number of assemblies in the racks, said labels in said sets being joined at an end to at least one other label of said set; and a labeling finisher for detaching said end of said each label from said at least one other label in said set and smoothing said ends of each of said labels onto their respective needle assembly.

11. The system of claim 10 wherein said label supply further comprises said sets of labels being releasably adhered to and linearly spaced a predetermined distance apart on one side of continuous release paper strip, said spacing substantially corresponding to a distance between the racks of said supply of needle assemblies.

12. The system of claim 11 wherein said labels are formed from paper having an exposed side and an adhesive side, said adhesive side having a layer of pressure sensitive adhesive applied thereto for releasably adhering said labels to said release paper and for fixedly adhering said labels to said needle assemblies.

13. The system of claim 12 wherein said label applicator further comprises a first reel, a second reel and a roller, said release paper having said labels thereon being unrollable from said first reel about said roller and being taken up on said second reel, said release paper forming an acute angle with said roller between said first and said second reel, said roller being disposed to present and to transfer said labels from said one side of said release paper strip to the needle assemblies in the racks.

14. The system of claim 13 wherein the joining of each label to at least one other label comprises perforations spaced at predetermined intervals so that one of said each label is applied to one of each of the needle assemblies and said perforations are intermediate each of the needle assemblies.

15. The system of claim 14 wherein said each label is detachable from said at least one other label at said perforation by said label finisher.

16. The system of claim 15 wherein said label finisher comprises a wheel having a plurality of outward teeth having a pitch substantially equal to the spacing between said perforations, said label finisher being disposed so that said teeth engage said perforations as said needle assemblies are moved through said label finisher on the racks, and detach said labels at said perforations.

17. The system of claim 12 wherein each of said labels further comprises a portion having reduced strength in comparison to another portion of said label so that when either of the shields is moved from an initial position to another position with respect to each other after said label is applied, said label substantially noticeably tears at said reduced strength portion thereby providing visual evidence of tampering with the assembly.

18. The system of claim 17 wherein said portion of each of said labels having reduced strength is selected from the group consisting of a plurality of openings through said label, slits therethrough, notches and combinations of openings, slits and notches so that when either of the shields is moved from an initial position to another position with respect to the hub after said label is applied, said label substantially noticeably tears at said portion thereby providing visual evidence of tampering with the assembly.

19. The system of claim 18 wherein said portion having reduced strength comprises a plurality of slits through said label.

* * * * *